United States Patent [19]

Zumpano

[11] 4,200,992

[45] May 6, 1980

[54] DRIERS FOR DRYING SKEINS OF YARNS AND OTHER PURPOSES

[76] Inventor: Antonio Zumpano, Via del Pozzo 13, Catena, Quarrata, Pistoia, Italy

[21] Appl. No.: 19,243

[22] Filed: Mar. 9, 1979

[30] Foreign Application Priority Data

Mar. 16, 1978 [IT] Italy ..... 9378 A/78

[51] Int. Cl.[2] ..... F26B 11/04

[52] U.S. Cl. ..... 34/58; 34/69; 34/151; 34/187; 131/137; 68/19.2; 198/678

[58] Field of Search ..... 68/19.2, 20, 23 R; 198/952, 678, 803, 645; 131/136, 137, 138, 139; 34/58, 69, 133, 151, 184, 187, 188

[56] References Cited

U.S. PATENT DOCUMENTS

| | | | |
|---|---|---|---|
| 309,419 | 12/1884 | Thompson | 34/188 |
| 581,948 | 5/1897 | Sjostrom | 198/678 |
| 791,803 | 6/1905 | MacLean | 131/137 |
| 990,749 | 4/1911 | Kretzschmar | 34/184 |
| 2,229,546 | 1/1941 | Bogaty | 131/136 |

*Primary Examiner*—Larry I. Schwartz

*Attorney, Agent, or Firm*—Hopgood, Calimafde, Kalil, Blaustein & Lieberman

[57] ABSTRACT

A drier suitable for drying yarn in skeins suspended from rods, comprises a rotor mounted for rotation about a horizontal axis. Access to the interior of the rotor is provided through doors in the rotor. Adjacent the door openings, the rotor has supports for receiving the ends of several rods with skeins suspended therefrom. Drying is effected by centrifugal effects and by circulation of air.

6 Claims, 8 Drawing Figures

DRIERS FOR DRYING SKEINS OF YARNS AND OTHER PURPOSES

FIELD OF THE INVENTION

The present invention relates to a rotary drier which can be used for drying skeins of yard.

SUMMARY OF THE INVENTION

According to the present invention, there is provided a rotary drier suitable for drying skeins of yarn suspended on rods, a rotor mounted for rotation about a horizontal axis, said rotor including means defining openings to provide access to the interior of the rotor, doors for closing the openings, and support means adjacent the openings for receiving the ends of said rods with the skeins suspended thereon, and means for providing a centrifugal effect and an air circulation effect for drying.

The support means may be provided along the edges of the openings, these edges being adjacent to the axial ends of the rotor.

The rotor may be housed in a casing which promotes the circulation of air through perforations in the wall of the rotor, circulation taking place by centrifugal effects. The air can enter the rotor axially, after having passed first through a heating unit.

The doors are preferably sealed by locking latches and safety inspection windows.

BRIEF DESCRIPTION OF THE DRAWINGS

An embodiment of the invention will now be described, by way of example only, with reference to the accompanying diagrammatic drawings, in which.

DESCRIPTION OF THE PREFERRED EMBODIMENT

Figure 1:
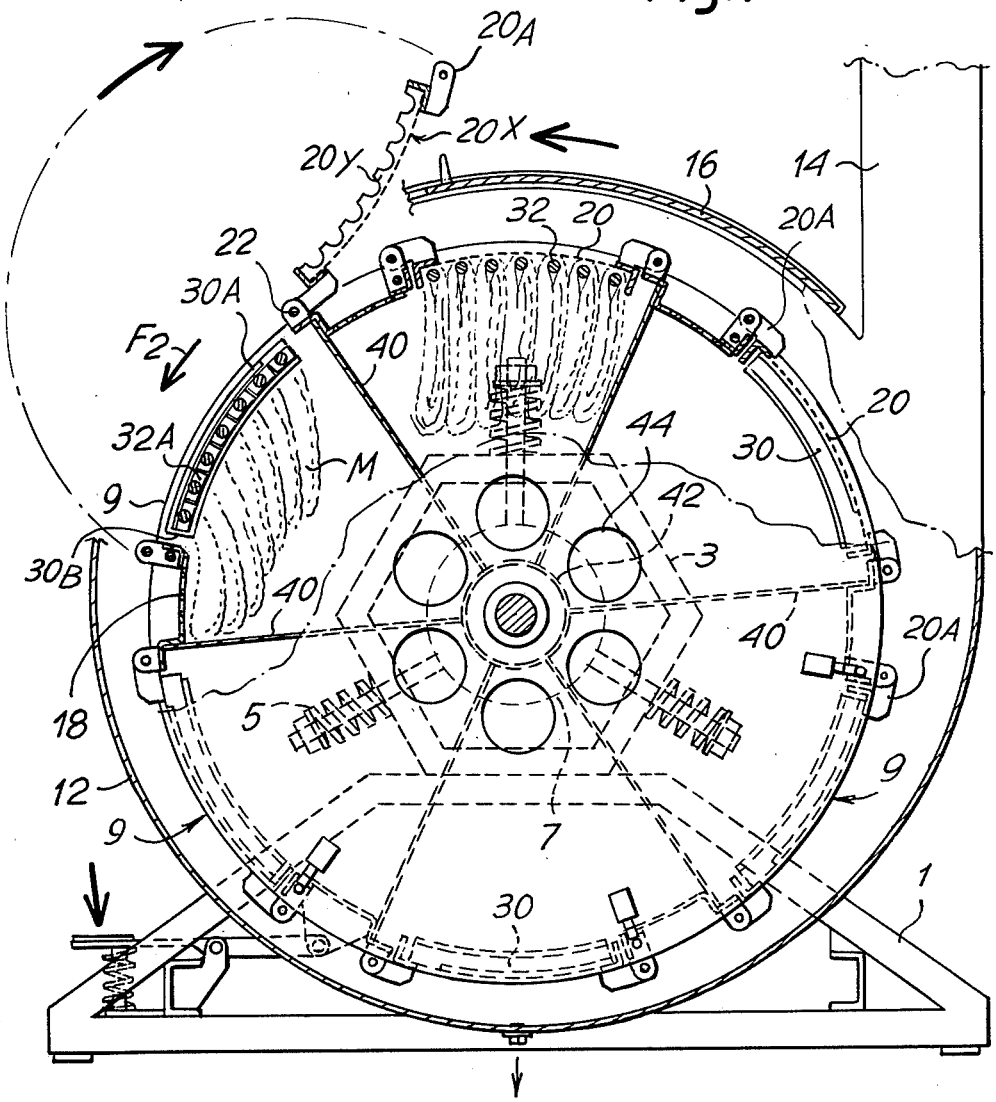
FIG. 1 is an axial end elevation, partly in section, of a drier in accordance with the invention.
Figure 2:
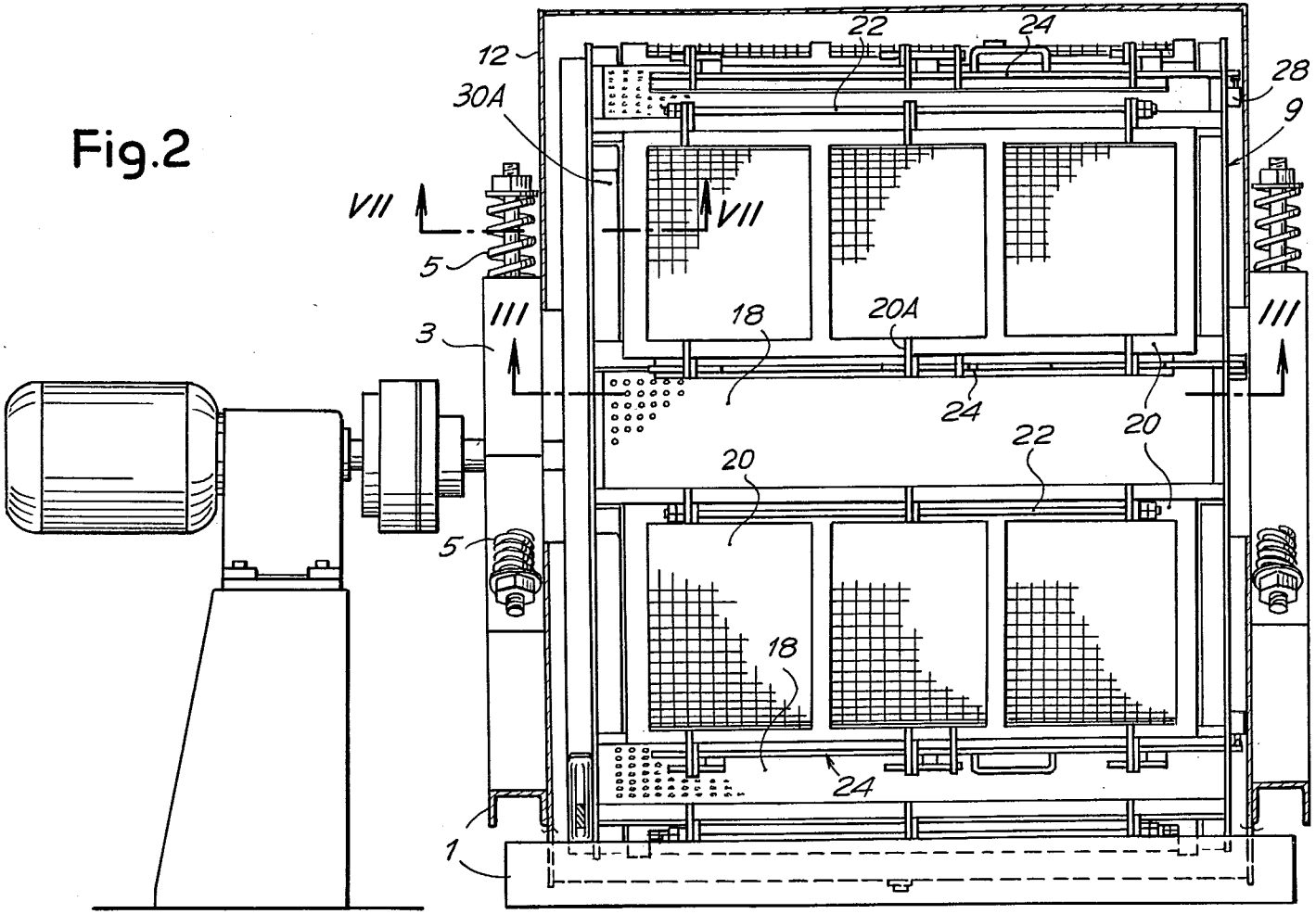
FIG. 2 is a side elevation of the drier.
Figure 3:
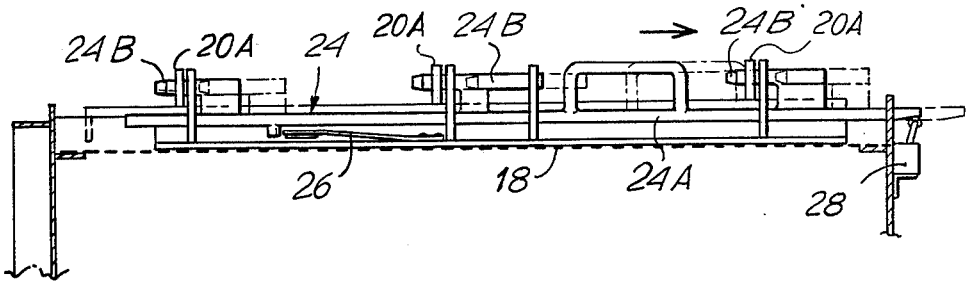
FIG. 3 is a section on line III—III of FIG. 2.
Figure 4:
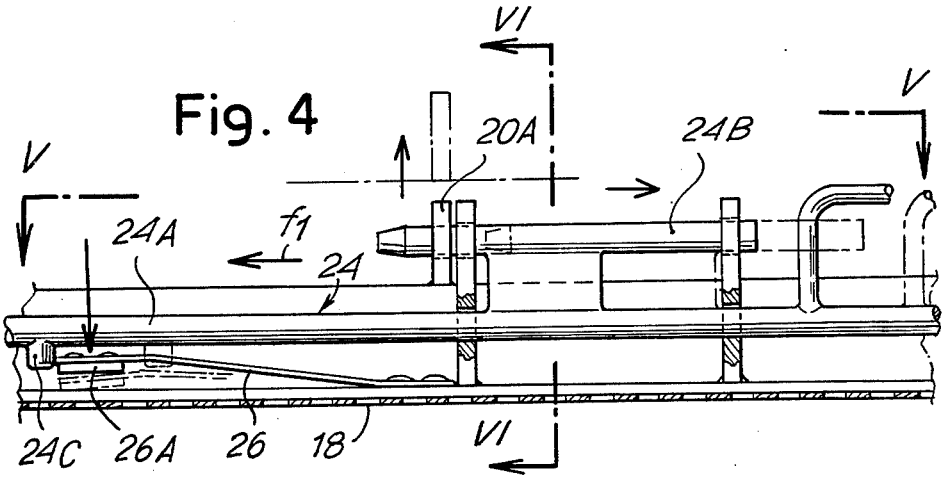
FIGS. 4 and 5 show respectively an enlarged detail of FIG. 3 and a view on line V—V of FIG. 4.
Figure 5:
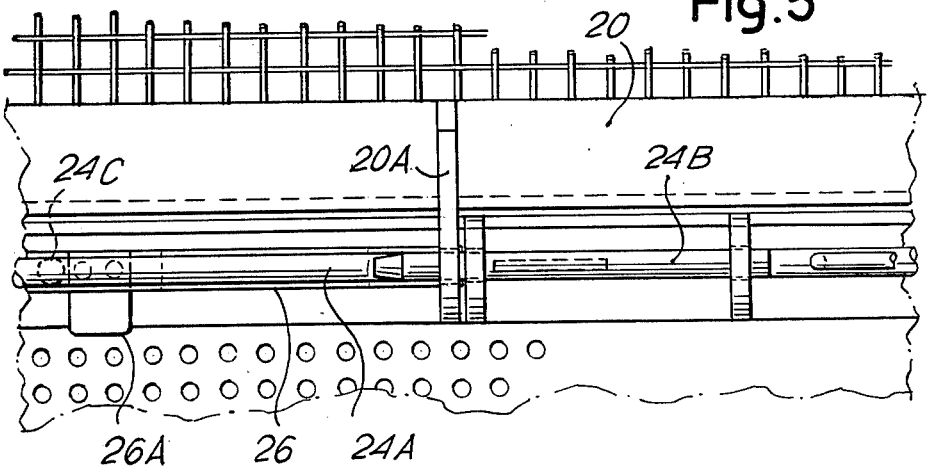
Figure 6:
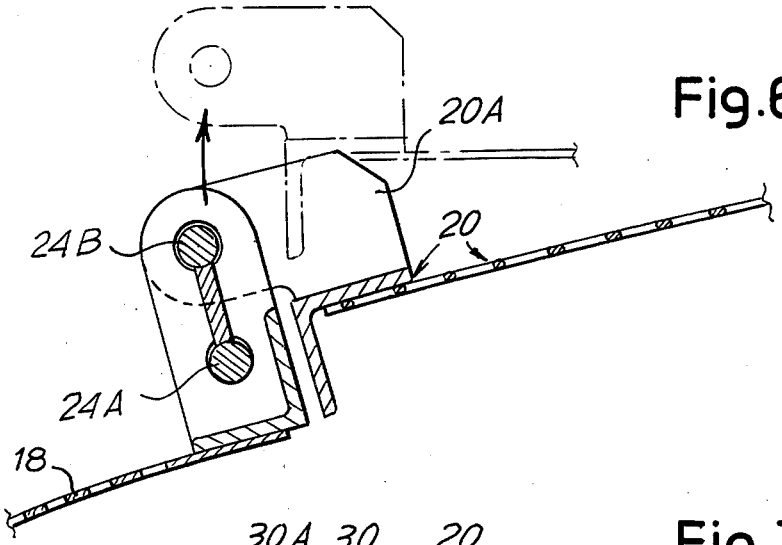
FIG. 6 shows a detail on line VI—VI of FIG. 4.

In the drier shown in the accompanying drawings, 1 denotes a support which has two polygonal lateral structures 3, through which, by means of springs 5, two supports 7 of a rotor 9 are held. The rotor 9 is actuated by an external electric motor via a suitably articulated transmission.

The rotor 9 is contained in a casing 12 which is preferably combined with a flue 14 for the discharge of fumes. The side of the casing 12 has, in its upper part, an access opening which can be closed, for example by a shutter 16.

The rotor 9 is in the form of a cylindrical drum, defined by fixed longitudinal perforate walls 18 of grid-like construction, and perforate doors 20 also of grid-like construction which can be opened to provide access to the interior of the drum. The area defined by the fixed walls 18 may be smaller than that shown and the fixed walls may even be omitted. The doors 20 are pivoted longitudinally at 22 so that they may be selectively opened as far as position 20X (FIG. 1), for example, through the opening provided in the casing 12.

The doors 20 can be locked by means of latches 24. These latches 24 each comprise a sliding shaft 24A with a plurality of pins 24B which can be inserted into eyes 20A of the doors in their closed position. To close the latch 24, its shaft 24A is moved in accordance with arrow $f_1$. The latch may be locked in its closed position by locking means constituted by a spring 26 which fits by a snap action onto an abutment 24C of the shaft 24 to prevent its accidental return to the open position, unless the spring is pressed onto an attachment 26A. These locks constitute one safety feature and other safety features may be provided which operate mechanically or electrically, for example a switch 28 which prevents the supply of current to the driving motor of the rotor 9, if any of the latches is not located in its door-locking position.

Figure 7:
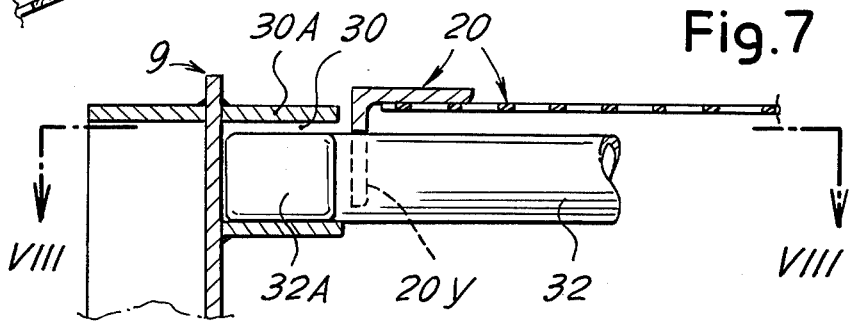
FIGS. 7 and 8 show respectively an enlarged detail, in section, on line VII—VII of FIG. 2 and a view on line VIII—VIII of FIG. 7.
Figure 8:
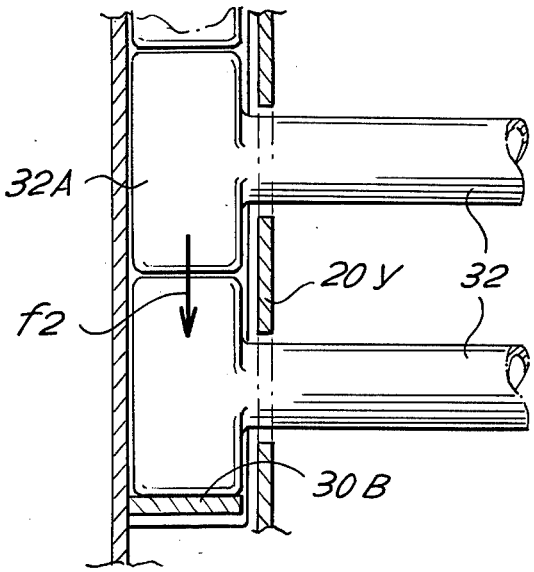

Each door 20 has along the external lateral sides two toothed edges 20X and 20Y (see FIGS. 1, 7 and 8). The rotor has adjacent each of these lateral sides of each door a channel 30, the outer side wall of which 30A is interrupted at the end portion adjacent to the door pivot 22; this interruption permits the insertion into the channel of hammer-shaped heads of rods 32 on which skeins M of yarn originating from previous dyeing processes are normally mounted. The rods 32 are equal in length to the longitudinal dimension of the openings for the doors 20. The heads 32A of the rods 32 are inserted into the interruptions of the side walls 30A and are slid along the channel in the direction of arrow $f_2$ in FIG. 8 and FIG. 1, until the endmost head abuts against a bottom wall 30B of the respective channel and the heads of adjacent rods 32 rest one against another.

The heads 32A of adjacent rods which rest one against another hold the rods sufficiently spaced to accommodate the skeins mounted on adjacent rods; this spacing is also ensured by the toothed edges 20X, 20Y of the doors 20, which, when closed, locate the rods in their inter-tooth spaces and lock the rods 30.

The skeins are loaded into the drum at the position at which each door may be opened as shown in FIG. 1. Prior to loading, several skeins are already on each rod as the rod has carried these skeins during a preceding treatment, and the loading of the skeins into the drum is effected simply by inserting the rods with the skeins thereon, subsequent unloading being effected simply by removing the rods. It will thus be appreciated that skeins are not handled individually when loading and unloading.

The interior of the drum is divided into a plurality of sectors, with each door 20 opening into a respective one of the sectors. This subdivision is effected by partitions 40 which extend axially of the drum and radially from a central tubular duct 42 to a position adjacent respective ones of the pivots 22 (see FIG. 1). One axial end wall of the drum includes holes 44 which open directly into the sectors, and/or into the sectors indirectly through the duct 42 and via radial holes therein. Air entering the drum via the holes 44 is circulated from the central area of the drum towards the periphery, with the formation of a current of air by centrifugal effect during the rotation of the drum. The air entering through the holes 44 may be suitably heated by means of a stationary heating assembly at the side of the rotor; the heating assembly can be of any suitable type, for example steam or electric.

With the circulation of the heated air and the discharge of same through the casing 12 and the flue 14, the moisture of the material of the skeins M is quickly eliminated. This remains in substantially regular skeins as a result of the contact between skeins and the adjacent wall 18, as well as with the door 20, in such a manner that the skeins are dried both by centrifugal action on the liquid and by the passage of hot air through the material.

The presence of the partitions 40 which subdivide the rotor into sectors serves to make the drier also usuable for drying loose material, since for skeins along subdivision into sectors would not be necessary.

With the drier described, considerable advantages in terms of economy and operation are obtained. In particular the drier avoids the heavy costs of special material handling, for the reasons stated above. The skeins M can be dried to the desired degree and are held in a substantially regular position which is of advantage for subsequent processing. Furthermore, efficient results are obtained with a low consumption of power, and a good drying speed is achieved.

What is claimed is:

1. In a rotary drier suitable for drying skeins of yarn suspended on rods, a rotor mounted for rotation about a horizontal axis, said rotor including means defining a shell and enclosing a hollow interior and opening means defined in said shell to provide access to the interior of the rotor, doors for closing the openings, and support means adjacent the openings for receiving the ends of said rods with the skeins suspended thereon, and within said shell and means for rotating said rotor to provide a centrifugal effect and for effecting air circulation through said hollow interior for drying.

2. A drier according to claim 1, wherein the support means extend along edges of the openings, said edges being adjacent to the ends of the rotor.

3. A drier according to claim 1, further comprising means dividing the interior of the rotor into sectors which can receive loose material for drying, each said sector being associated with a respective said opening in the rotor to provide access to the sector.

4. A drier according to claim 1, further comprising a casing housing the rotor, the shell of said rotor being perforate whereby air passes through the rotor shell into the casing.

5. A drier according to claim 4, further comprising means defining an axial inlet into the rotor shell for heated air.

6. A drier according to claim 1, further comprising latches for locking the doors.

* * * * *